US012364343B2

(12) United States Patent
Huff et al.

(10) Patent No.: US 12,364,343 B2
(45) Date of Patent: Jul. 22, 2025

(54) REFRIGERATED DISPLAY CABINET AND METHOD OF DISPERSING A BUILDUP OF REFRIGERANT GAS

(71) Applicant: Carrier Corporation, Palm Beach Gardens, FL (US)

(72) Inventors: Hans-Joachim Huff, Mainz-Kostheim (DE); Michael Kunz, Mainz-Kostheim (DE); Benjamin Kahl, Mainz-Kostheim (DE); Michael Panzer, Mainz-Kostheim (DE); Konstantin Weber, Mainz-Kostheim (DE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 194 days.

(21) Appl. No.: 18/188,518

(22) Filed: Mar. 23, 2023

(65) Prior Publication Data

US 2023/0301446 A1 Sep. 28, 2023

(30) Foreign Application Priority Data

Mar. 23, 2022 (EP) ..... 22163862

(51) Int. Cl.
*A47F 3/04* (2006.01)

(52) U.S. Cl.
CPC ..... *A47F 3/0443* (2013.01); *A47F 3/0447* (2013.01)

(58) Field of Classification Search
CPC .... A47F 3/0443; A47F 3/0447; A47F 3/0478; A47F 3/0469; A47F 7/0071; F25D 23/003; F25B 1/00; F25B 2400/22; F25B 2500/22
See application file for complete search history.

(56) References Cited

U.S. PATENT DOCUMENTS 3,263,745 A * 8/1966 Henry ..... A47F 3/0447 165/918
5,358,444 A 10/1994 Helm et al.
6,073,547 A 6/2000 Westbrooks, Jr. et al.
6,315,656 B1 11/2001 Pawlowski
(Continued)

FOREIGN PATENT DOCUMENTS

CA 1308801 C 10/1992
CN 102566711 A 7/2012
(Continued)

OTHER PUBLICATIONS

European Search Report for Application No. 22163862.0; Issued Nov. 6, 2024; 4 Pages.
(Continued)

*Primary Examiner* — Emmanuel E Duke
(74) *Attorney, Agent, or Firm* — CANTOR COLBURN LLP

(57) ABSTRACT

A refrigerated display cabinet includes a refrigeration loop including a compressor, a condenser, a throttling element and an evaporator; a main body comprising a storage space, the evaporator is for cooling the storage space and at least one of the compressor, condenser and throttling element are located outside of the storage space; and a fan arrangement located outside of the storage space, configured to direct air to disperse any build-up of gases located in a region surrounding the bottom of the refrigerated display cabinet.

14 Claims, 6 Drawing Sheets

(56) References Cited

U.S. PATENT DOCUMENTS

| | | | | |
|---|---|---|---|---|
| 6,379,240 | B2 * | 4/2002 | Livchak | A47F 3/0447 454/193 |
| 6,533,657 | B2 | 3/2003 | Monson et al. | |
| 6,745,579 | B2 | 6/2004 | Spinazzola et al. | |
| 7,525,799 | B2 | 4/2009 | Lai et al. | |
| 8,749,976 | B2 | 6/2014 | Fernandez et al. | |
| 9,265,359 | B2 | 2/2016 | Wood et al. | |
| 11,132,035 | B2 | 9/2021 | Lewis, II | |
| 2008/0151497 | A1 | 6/2008 | Lai et al. | |
| 2008/0160902 | A1 | 7/2008 | Desler | |
| 2019/0376723 | A1 | 12/2019 | Rigg et al. | |
| 2022/0090830 | A1 * | 3/2022 | Sung | F25D 23/006 |

FOREIGN PATENT DOCUMENTS

| | | | | |
|---|---|---|---|---|
| CN | 102770007 | A | | 11/2012 |
| CN | 104223854 | A | * | 12/2014 |
| CN | 102480897 | B | | 6/2016 |
| CN | 105932573 | A | | 9/2016 |
| CN | 106451111 | A | | 2/2017 |
| CN | 106532513 | A | | 3/2017 |
| CN | 107202415 | A | | 9/2017 |
| CN | 107482504 | A | | 12/2017 |
| CN | 108224566 | A | | 6/2018 |
| CN | 108224567 | A | | 6/2018 |
| CN | 109963441 | A | | 7/2019 |
| CN | 111697287 | A | | 9/2020 |
| DE | 102014101453 | A1 | | 8/2015 |
| EP | 1588110 | B1 | | 7/2009 |
| EP | 2587178 | A1 | | 5/2013 |
| EP | 2389550 | B1 | | 6/2017 |
| EP | 2391859 | B1 | | 7/2017 |
| EP | 2391858 | B1 | | 3/2019 |
| JP | H0791795 | A | | 4/1995 |
| JP | 2002221385 | A | | 8/2002 |
| JP | 2011242104 | A | * | 12/2011 |
| JP | 2012249957 | A | | 12/2012 |
| KR | 100803463 | B1 | | 2/2008 |
| WO | 2002037918 | A1 | | 5/2002 |

OTHER PUBLICATIONS

European Search Report for Application No. 22163862.0; Issued Sep. 12, 2022; 8 Pages.

* cited by examiner

REFRIGERATED DISPLAY CABINET AND METHOD OF DISPERSING A BUILDUP OF REFRIGERANT GAS

FOREIGN PRIORITY

This application claims priority to European Patent Application No. 22163862.0, filed Mar. 23, 2022, and all the benefits accruing therefrom under 35 U.S.C. § 119, the contents of which in its entirety are herein incorporated by reference.

TECHNICAL FIELD OF INVENTION

The present invention relates to refrigerated display cabinets, and more specifically, refrigerated display cabinets capable of dispersing a build-up of refrigerant gas. Corresponding methods are also described.

BACKGROUND OF THE INVENTION

Refrigerated display cabinets as used in retail environments provide refrigerated display spaces for refrigerated goods, such as perishable goods or goods where a chilled sales condition is preferred by the consumer. The refrigerated display cabinet keeps the goods below ambient temperature by the use of cooled air that is circulated around the goods. Typically, a refrigerated display cabinet will include a storage space with a number of horizontal shelves and an opening at a front side of the shelves. The opening permits a consumer and/or retail staff to access the shelves and the goods thereon from the front of the storage space. In some cases, the opening can be shielded by a door or a curtain. An air curtain may be used, for example a flow of cooled and/or ambient air across the opening. Cooling for the refrigerated display cabinet is provided by heat exchange with a heat absorbing heat exchanger of a cooler. This may be a cooler integrated with the display cabinet, such as a refrigeration loop with an evaporator of the refrigeration loop being the heat absorbing heat exchanger. The refrigerant loop further comprises a condenser as a heat rejection heat exchanger, which is usually located away from the refrigerated space, such as behind, above or below the refrigerated display cabinet. In some cases, a cooling system at a remote location may link to heat rejection heat exchangers at multiple refrigerated display cabinets via a heat exchange circuit.

The refrigerant used in the refrigeration loop is usually flammable, for example hydrocarbons such as propane are used as refrigerant, and hence there is a risk of an explosive/flammable atmosphere in the vicinity of the refrigerated cabinet if refrigerant were to leak and be allowed to accumulate.

A need therefore exists for a refrigerated cabinet design that prevents the accumulation of refrigerant in the event of a refrigerant leak.

SUMMARY OF THE INVENTION

According to one aspect the present invention provides a refrigerated display cabinet, comprising: a refrigeration loop comprising a compressor, a condenser, a throttling element and an evaporator; a main body comprising a storage space, wherein the evaporator is for cooling the storage space and wherein at least one of the compressor, condenser and throttling element are located outside of the storage space; and a fan arrangement located outside of the storage space, configured to direct air to disperse any build-up of gases in a region surrounding the bottom of the refrigerated display cabinet.

Leaks of refrigerant gas may occur from any component of the refrigeration loop that carries refrigerant, e.g. the compressor. As this refrigerant is typically denser than ambient air (i.e. air surrounding the cabinet), it has been found that it falls towards the bottom of the cabinet and collects in the region surrounding the bottom of the refrigerated display cabinet and. It has also been found to sometimes collect beneath the refrigerated display cabinet if there is an open volume there (i.e. a space between the refrigerated cabinet and the floor). The build-up of gases in either of these areas is a fire risk, as the collected refrigerant is typically flammable and electrical components located near the bottom of the cabinet may ignite the refrigerant. The present invention mitigates this fire risk by directing air into the region surrounding the bottom of the cabinet in order to disperse gas that collects there. This helps the cabinet to meet the International Standard IEC 60335-2-89 requirement for minimising the risk of ignition of flammable refrigerant.

The region surrounding the bottom of the refrigerated display cabinet may comprise a volume extending at least 50 mm outwards from an edge of the bottom of the refrigerated display cabinet and at least 50 mm upwards from a surface on which the refrigerated display cabinet stands during use. This region is that where a refrigerant leak is most likely to collect following a leak and therefore poses the greatest fire risk, which is why the International standard mentioned above requires measurements to be taken in this region.

The main body may comprise a base panel and the fan arrangement may be configured to also direct air to disperse a build-up of gases located in a space beneath the refrigerated display cabinet, the space defined as the volume between the base panel and a surface on which the refrigerated display cabinet stands during use. As mentioned above, this space (if present) also poses a fire risk.

It will be appreciated that the refrigerated display cabinet is oriented in use with a top and a bottom, and hence as used herein references to horizontal and vertical should be understood with reference to that orientation. The refrigerated display cabinet has a vertical extent between the top and the bottom thereof, and a horizontal extent between the front and back (a depth of the cabinet), as well as between two sides (a width of the cabinet). The storage space may be accessible from a front of the refrigerated display cabinet. The refrigeration display cabinet may have a height greater than 1.5 m. The refrigeration display cabinet may have a height greater than 2 m. The refrigeration display cabinet may have a height of about 2.5 m or less.

The refrigerated display cabinet may comprise a kick-plate positioned at a bottom edge at the front of the refrigerated display cabinet, wherein the kick-plate is perforated to allow air directed by the fan arrangement to pass therethrough. This allows air into the region surrounding the bottom of the cabinet described above. Similar plates may be present at any bottom edge of the cabinet, including the sides and/or back.

The refrigerated display cabinet may comprise one or more supports for bearing the weight of the refrigerated display cabinet, wherein the one or more supports pass through the space beneath the refrigerated display cabinet and rest on the surface (e.g. a floor) on which the refrigerated display cabinet stands during use.

The refrigeration loop may comprise a flammable refrigerant that is denser than ambient air, this may be propane, and/or may comprise other hydrocarbons such as R1270 (propylene), other flammable refrigerants such as R32, or HFO refrigerants in general. By ambient air it is meant air that would normally surround the display cabinet during use, e.g. room temperature.

The refrigerated display cabinet may comprise a duct, wherein the duct is arranged to direct air from the fan arrangement to the region surrounding the bottom of the refrigerated display cabinet, and optionally the space beneath the refrigerated display cabinet. By utilising a duct, air can be directed more precisely to the space in order to disperse gas.

The fan arrangement may be located at one end of the duct, and the other end of the duct may be positioned in or at an edge of the space beneath the refrigerated display cabinet.

There may be no other passages or openings connected to the duct. The duct may otherwise be airtight.

The duct may be located on an exterior surface of the refrigerated display cabinet. In particular, it has been found that having the duct on a rear surface of the display cabinet is advantageous as this provides a compact design. For example, when the fan arrangement is located on top of the cabinet, this provides a compact arrangement for directing air to the bottom of the cabinet and is not visible in normal use. The duct may terminate in a fanned section to aid in the dispersal of gases.

The fan arrangement may be located above the main body of the refrigerated display cabinet. In particular, the fan arrangement may be located on top of the display cabinet. In this location the fan arrangement is unlikely to be kicked by people walking near the display cabinet, is not visible in normal use, and the space utilised is otherwise empty.

Alternatively, the fan arrangement may be located in the space beneath the refrigerated display cabinet, or the fan arrangement may be located on a side of the refrigerated display cabinet.

The fan arrangement may be located beneath a front edge of the cabinet, to direct air from in front of the cabinet into the space beneath the cabinet. Alternatively, the fan arrangement may be located on the front canopy of the cabinet, directing air downwards.

The fan arrangement may be powered separately to the refrigeration loop and/or the remainder of the refrigerated display cabinet. This means that the fan arrangement still directs air to mitigate fire risk even when the display cabinet/refrigeration loop are not powered (e.g. in the case of power failure to the components). This ensures fire risk is mitigated at all times, which is important as refrigerant leaks may still occur even when the refrigeration loop is not powered/functioning.

The fan arrangement may comprise a plurality of fans (e.g. 2, 3, 4, 5, or more than 5). These fans may be positioned adjacent to one another. When a duct is used additional fans may be placed in the duct (e.g. at positions along its length) to improve airflow.

The refrigerated display cabinet may comprise a container, wherein the container contains a refrigerating component (e.g. at least one of the compressor, condenser and throttling element). The container may comprise a vent and the fan arrangement may be configured to draw gas from inside of the container through the vent to discharge any build-up of gases within the container.

With this arrangement, any gas leak, such as a refrigerant leak, from any component contained within the container, will be prevented from build-up within the container as the fan arrangement removes it. It has been realised that the same fan arrangement can be used to achieve the dispersing of gas in the region surrounding the bottom of the display cabinet (discussed above) and the venting of gas from within the container. However, it will be appreciated that different fan arrangements could also be utilised if necessary. As it is discharged any leaked gas will mix with the surrounding air and will be diluted. This therefore prevents any build-up of potentially flammable gases in the container and in the vicinity of the refrigerated display cabinet.

The container may be configured to be air tight with the exception of a portion (e.g. a vent) through which air is drawn by the fan arrangement.

The container may be located above the main body. The container may be installed on top of the main body. Alternatively, the container may be located below the storage space.

It will be appreciated that the container may be cuboid in its geometry. However, it may also be an irregular shape for example multiple cuboids interconnected or other shapes suitable for containing refrigeration loop components. The container shape may be irregular to accommodate the positioning of refrigeration loop components.

According to a second aspect the present invention provides a method of dispersing a build-up of refrigerant gas in a region surrounding the bottom of a refrigerated display cabinet, the method comprising: directing a flow of air from a fan arrangement to the region surrounding a bottom of the refrigerated display cabinet.

The method may comprise directing a flow of air from the fan arrangement to a space beneath the refrigerated display cabinet to disperse a build-up of gas beneath the cabinet.

The method according to the second aspect may be performed using the refrigerated display cabinet according to the first aspect, including any of the optional features described herein.

The fan arrangement may be powered separately to a refrigeration loop of the refrigerated display cabinet and/or the remainder of the refrigerated display cabinet, and the method may comprise: powering the fan arrangement to direct air to the region surrounding the bottom of the refrigerated display cabinet and optionally the space beneath the refrigerated display cabinet regardless of the power status of the refrigeration loop of the refrigerated display cabinet and/or the remainder of the refrigerated display cabinet.

The method may comprise supporting the refrigerated display cabinet on a surface, wherein the main body comprises a base panel and the space beneath the refrigerated display cabinet is defined by the volume between the base panel and the surface on which the refrigerated display cabinet stands during use.

The refrigerated display cabinet may comprise a duct and the method may comprise directing air from the fan arrangement via the duct to the region surrounding the bottom of the refrigerated display cabinet and optionally the space beneath the refrigerated display cabinet.

The method according to the second aspect may be performed using the refrigerated display cabinet according to the first aspect, including any of the optional features described herein.

According to a third aspect the present invention provides a method of manufacturing a refrigerated display cabinet, the method comprising: providing a refrigerated display cabinet including: a refrigeration loop comprising a compressor, a condenser, a throttling element and an evaporator; a main body comprising a storage space, wherein the evaporator is for cooling the storage space and wherein at least one of the compressor, condenser and throttling element are located outside of the storage space; and a fan arrangement located outside of the storage space, configured to direct air to disperse any build-up of gases located in a region surrounding the bottom of the refrigerated display cabinet and optionally the space beneath the refrigerated display cabinet.

The method may comprise retrofitting the fan arrangement to an existing refrigerated display cabinet. This allows existing display cabinets to be modified to reduce their fire risk.

The refrigerated display cabinet may include a duct that is arranged to direct air from the fan arrangement to the region surrounding the bottom of the refrigerated display cabinet and optionally the space beneath the refrigerated display cabinet, and the method may comprise retrofitting the duct to an existing refrigerated display cabinet. This allows existing display cabinets to be modified to reduce their fire risk.

The method according to the third aspect may be used to provide the refrigerated display cabinet according to the first aspect, including any of the optional features described herein.

BRIEF DESCRIPTION OF THE DRAWINGS

Certain preferred embodiments of the present invention will now be described in greater detail, by way of example only and with reference to the following figures, in which.

DETAILED DESCRIPTION OF THE INVENTION

Figure 1:
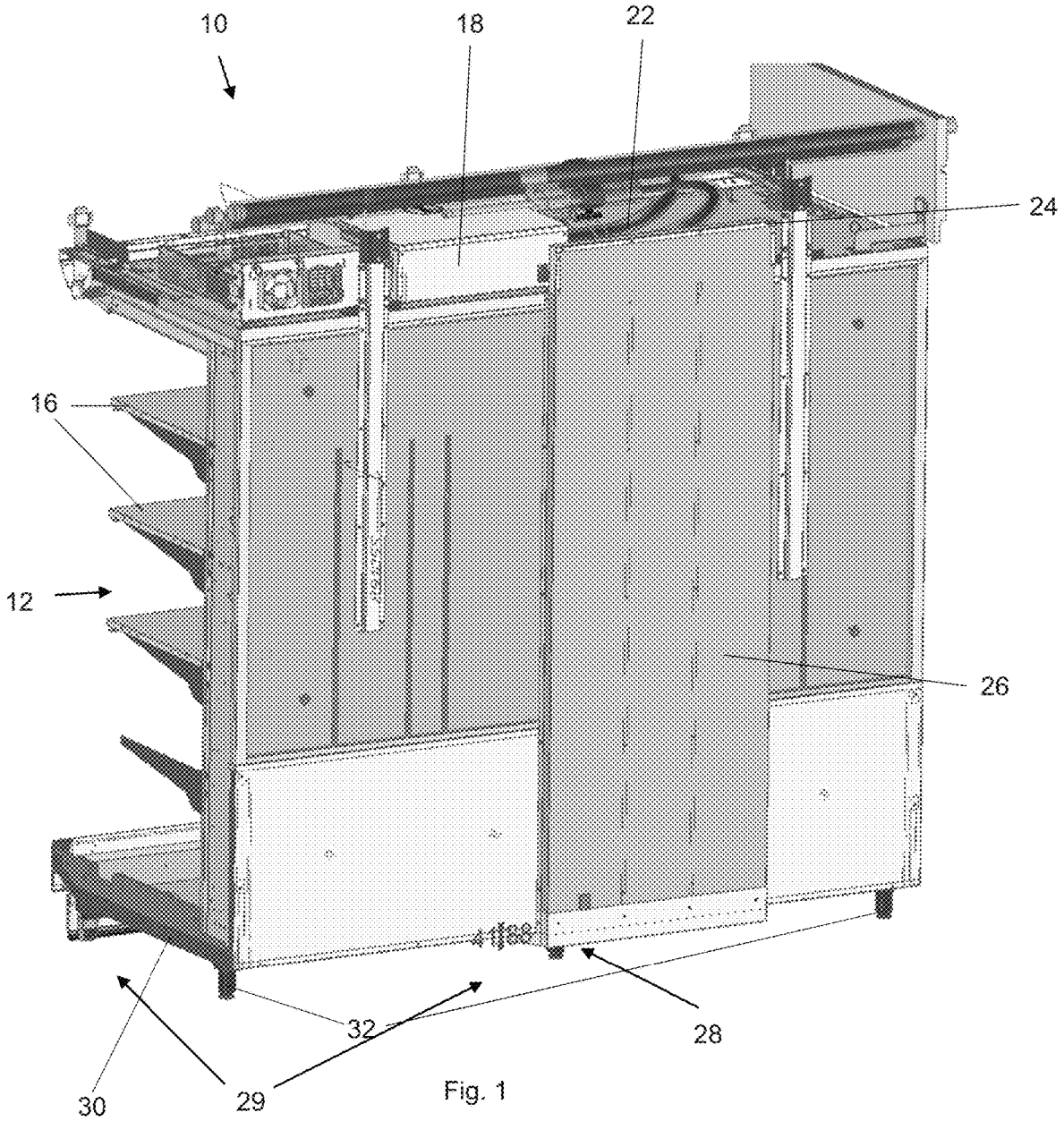
FIG. 1 shows a refrigerated display cabinet.
Figure 2:
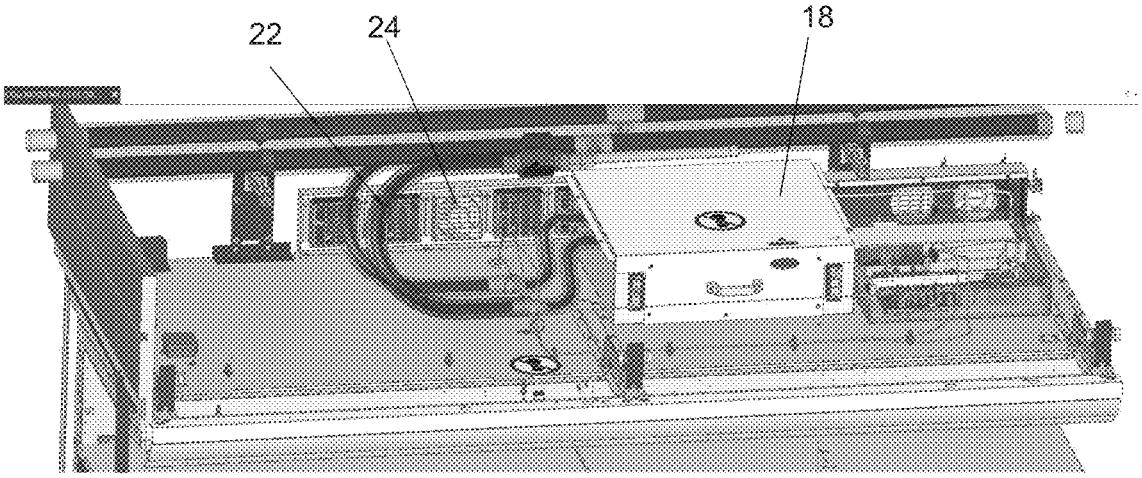
FIG. 2 shows the top of the refrigerated display cabinet of FIG. 1.

FIG. 1 shows an example of a refrigerated display cabinet 10. The refrigerated display cabinet 10 includes a main body 12 which comprises a refrigerated storage space 14 including a plurality of shelves 16. The refrigerated display cabinet 10 also includes a container 18 located on top of the main body 12.

The refrigerated display cabinet comprises a refrigeration loop which includes at least a compressor, a condenser and a throttling element which are connected to one another (not visible in FIG. 1). The refrigeration loop contains a flammable refrigerant that is denser than air; propane.

In the example shown in FIG. 1 the condenser and compressor are housed within the container 18. In this example the condenser is a liquid cooled heat exchanger which receives cooling fluid from an external source via cooling supply pipes 22.

The refrigerated display cabinet 10 also comprises a fan arrangement 24 and a duct 26. The duct 26 is fitted to the rear surface of the main body 12 and runs along its length. The fan arrangement 24 is positioned at a top end of the duct 26 and the duct 26 terminates below a bottom edge of the main body 12, in a space 28 beneath the cabinet.

The fan arrangement 24 is configured to draw in air from the region at top of the display cabinet and direct it, via the duct 24, to disperse any build-up of gases located in a region 29 surrounding the bottom of the refrigerated display cabinet and in a space 28 beneath the refrigerated display cabinet. In this way, any propane that leaks from the refrigerant loop and collects in the region 29 or space 28 beneath the cabinet (due to its density) is dispersed, thus minimising fire risk.

The fan arrangement 24 is powered separately to the refrigeration loop and the remainder of the refrigerated display cabinet so that it can function independently. This means the dispersing of gas in the region 29 surrounding the bottom of the cabinet and space 28 beneath the cabinet can always be performed regardless of the functioning of the rest of the refrigerated display cabinet, which is important as refrigerant can still leak even when the refrigerant loop is not powered.

The main body 12 of the refrigerated display cabinet comprises a base panel 30 and the space 28 beneath the refrigerated display cabinet is defined by the volume between the base panel 30 and a surface on which the refrigerated display cabinet stands during use.

The refrigerated display cabinet 10 comprises four legs 32 for bearing the weight of the refrigerated display cabinet 10; these pass through the space 28 beneath the refrigerated display cabinet 10 and rest on the surface on which the refrigerated display cabinet 10 stands during use.

Figure 6:
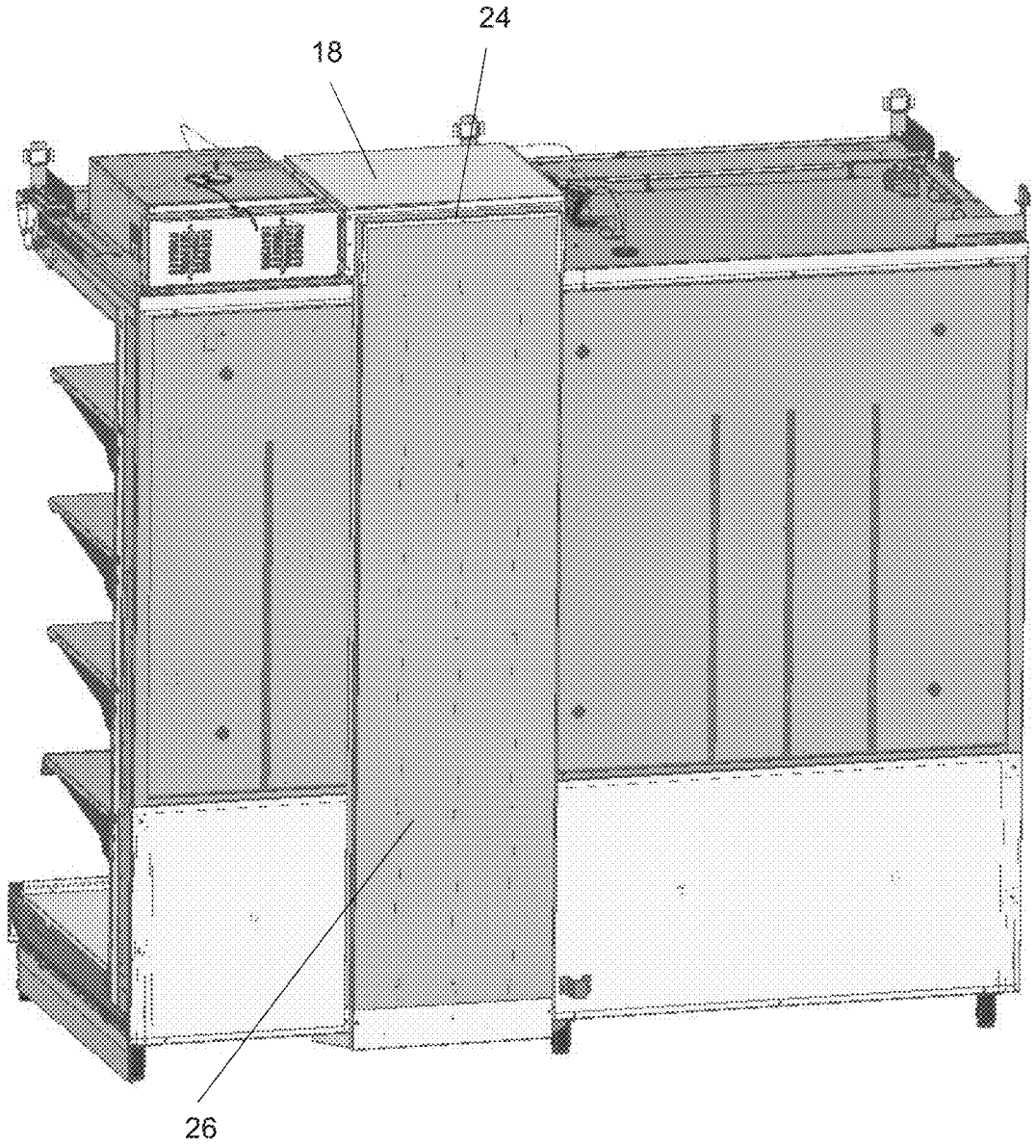
FIG. 6 shows an alternative placement of the fan arrangement in a refrigerated display cabinet.

It should be appreciated that alternatively, or in addition to the arrangement described above, the fan arrangement 24 may be connected to a vent of the container 18 to draw gas from inside of the container 18 through the vent to discharge any build-up of gases within the container 18, as shown in FIG. 6. This is advantageous as the refrigerant loop components within the container 18 carry flammable refrigerant and so a leak of refrigerant may result in a build-up of flammable gas in the container 18. It has been realised that a single fan arrangement 24 can discharge build-up of gas within the container 18 and disperse gas in the space 28 beneath the refrigerated display cabinet 10.

A method of dispersing a build-up of refrigerant gas in a region surrounding the bottom of a refrigerated display cabined and beneath a refrigerated display cabinet can be performed using the display cabinet 10 of FIG. 1 by directing a flow of air from the fan arrangement 24 to the region 29 surrounding the cabinet and space 28 beneath the refrigerated display cabinet.

A method of manufacturing a refrigerated display cabinet may 28 be performed to provide the refrigerated display cabinet 10 of FIG. 1.

The fan arrangement 24 and duct 26 can be retrofitted to an existing refrigerated display cabinet in order to minimise fire risks associated with leaked refrigerant.

Fire 2 shows the top of the refrigerated display cabinet of FIG. 1. Here, the fan arrangement 24, container 18, and cooling fluid supply line 22 can be seen more clearly.

Figure 3:
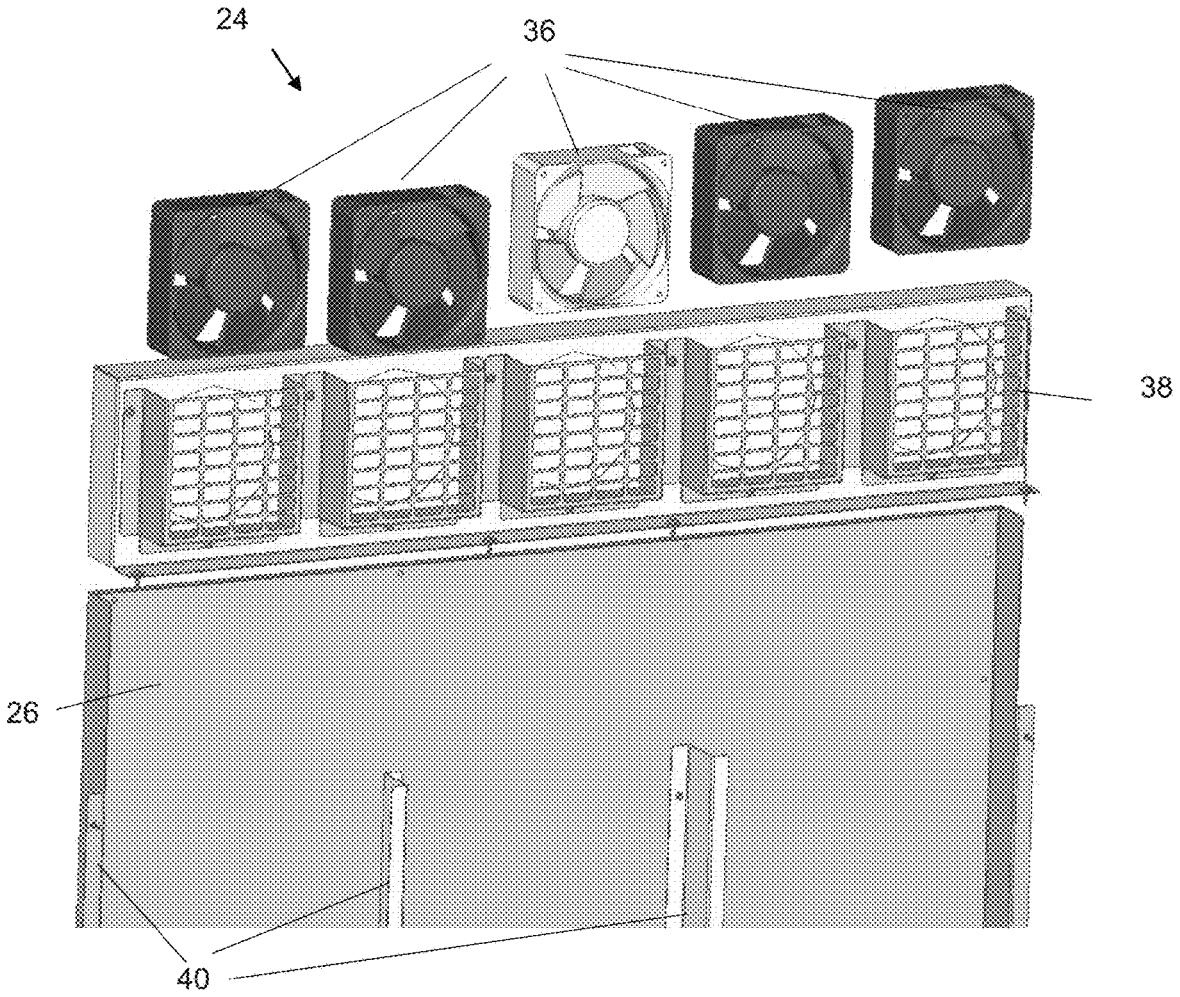
FIG. 3 shows an exploded view of a fan arrangement.

FIG. 3 shows an exploded view of the fan arrangement 24. Here it can be seen that the fan arrangement 24 composes five fans 36 positioned adjacent to one another at one end of the duct 26. Each fan 36 is seated within its own housing 38 and each housing may also hold a filter. In this figure the brackets 40 used to mount the duct 26 can also be seen. These can be used to retrofit the duct 26 to an existing refrigerated display cabinet 10.

Figures 4A, 4B:
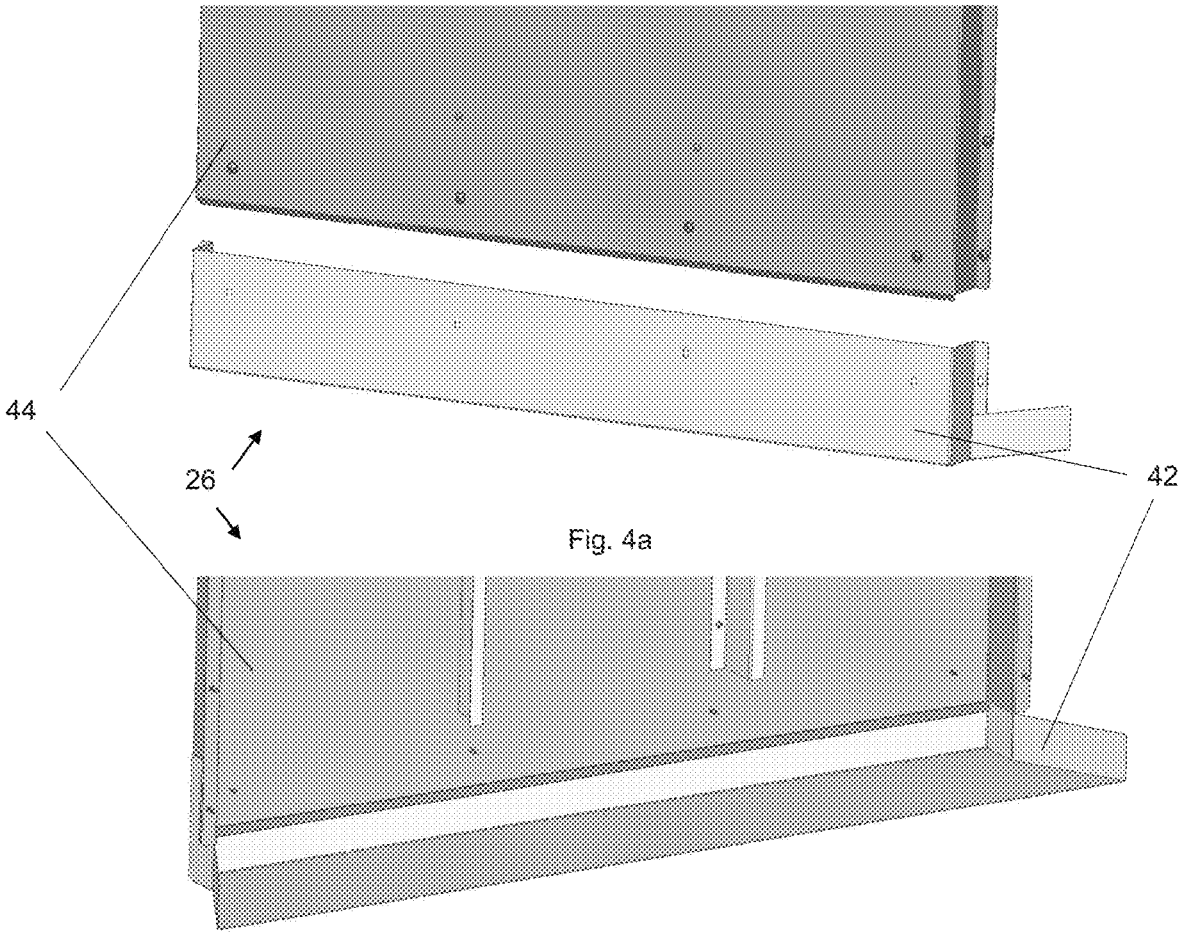
FIGS. 4*a* and 4*b* show a duct.

FIGS. 4*a* and 4*b* show the bottom opening of the duct 26. It can be seen that the duct 26 terminates in a fanned section 42 that is configured to extend beneath the cabinet at a right angle to the main body 44 of the duct. This fanned section 42 helps to disperse air more effectively to the entire space 28 beneath the refrigerated display cabinet and region 29 surrounding the bottom of the cabinet.

Figure 5:
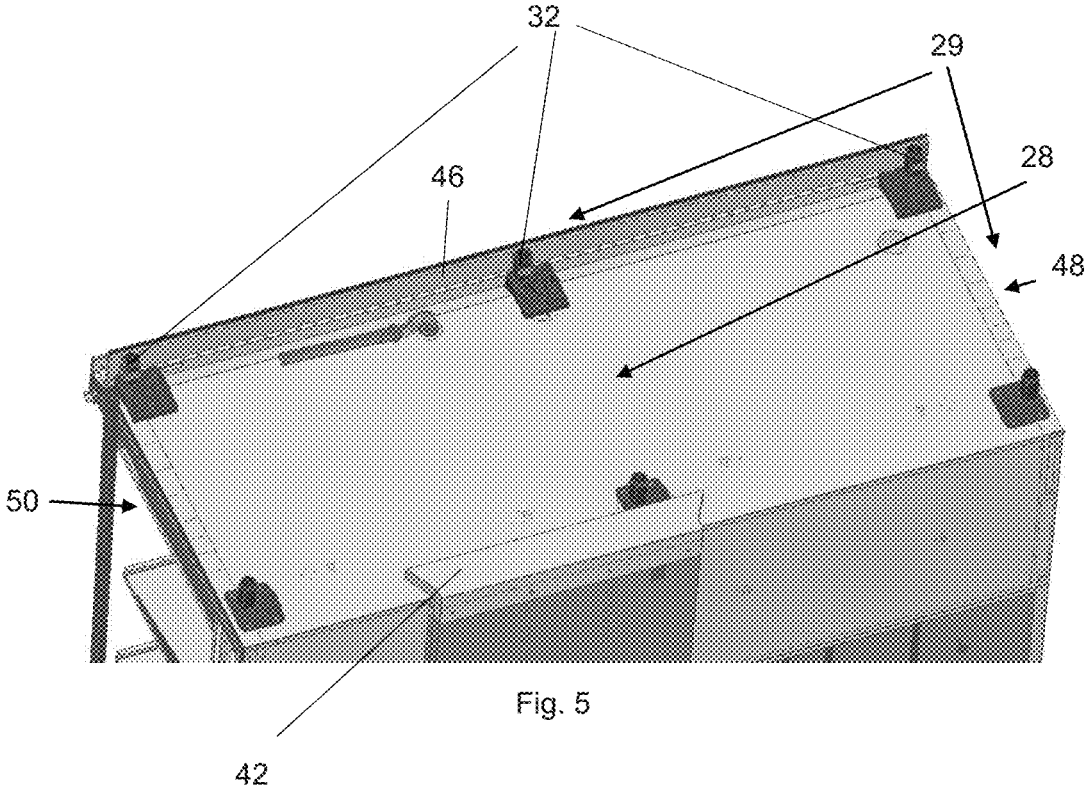
FIG. 5 shows the bottom of the refrigerated display cabinet of FIG. 1.

FIG. 5 shows the bottom of the refrigerated display cabinet 10. Here, the legs 32 and fanned section 44 of the duct can be seen more clearly. It will be appreciated that air flow from the fanned section 44 of the duct will pass through the kick plate 46 (which is perforated) positioned at the front of the cabinet to aid in the dispersal of gas in the portion of region 29 surrounding the bottom of the cabinet at its front. In addition to this, air would exit the space 28 to enter the region 29 surrounding the bottom of the cabinet at the left and right via the left 48 and right 50 side openings, as well as out the rear of the space 28 to disperse gas in region 29 behind the bottom of the cabinet.

What is claimed is:

1. A refrigerated display cabinet, comprising:

a refrigeration loop comprising a compressor, a condenser, a throttling element and an evaporator;

a main body comprising a storage space, wherein the evaporator is for cooling the storage space and wherein at least one of the compressor, condenser and throttling element are located outside of the storage space; and a fan arrangement located outside of the storage space, configured to direct air to disperse any build-up of gases in a region surrounding the bottom of the refrigerated display cabinet, wherein the fan arrangement is powered separately to the refrigeration loop or the remainder of the refrigerated display cabinet.

2. The refrigerated display cabinet according to claim 1, wherein the region surrounding the bottom of the refrigerated display cabinet comprises a volume extending at least 50 mm outwards from an edge of the bottom of the refrigerated display cabinet and at least 50 mm upwards from a surface on which the refrigerated display cabinet stands during use.

3. The refrigerated display cabinet according to claim 1, wherein the main body comprises a base panel and the fan arrangement is also configured to direct air to disperse a build-up of gases located in a space beneath the refrigerated display cabinet, defined as the volume between the base panel and a surface on which the refrigerated display cabinet stands during use.

4. The refrigerated display cabinet according to claim 1, comprising a kick-plate positioned at a bottom edge at the front of the refrigerated display cabinet, wherein the kick-plate is perforated to allow air directed by the fan arrangement to pass therethrough.

5. The refrigerated display cabinet according to claim 1, wherein the refrigeration loop comprises a flammable refrigerant that is denser than ambient air.

6. The refrigerated display cabinet according to claim 1, comprising a duct, wherein the duct is arranged to direct air from the fan arrangement to the region surrounding the bottom of the refrigerated display cabinet.

7. The refrigerated display cabinet according to claim 6, wherein the fan arrangement is located at one end of the duct, and the other end of the duct is positioned in or at an edge of a space beneath the refrigerated display cabinet.

8. The refrigerated display cabinet according to claim 1, wherein the duct is located on an exterior surface of the refrigerated display cabinet.

9. The refrigerated display cabinet according to claim 1, wherein the fan arrangement is located above the main body of the refrigerated display cabinet, the fan arrangement is located in a space beneath the refrigerated display cabinet, or wherein the fan arrangement is located on a side of the refrigerated display cabinet.

10. The refrigerated display cabinet according to claim 1, comprising a container, wherein the container contains at least one of the compressor, condenser and throttling element, the container comprises part of the refrigeration loop and is configured to draw gas from inside of the container through the vent to discharge any build-up of gases within the container.

11. A method of dispersing a build-up of refrigerant gas in a region surrounding the bottom of a refrigerated display cabinet according to claim 1, the method comprising:

directing a flow of air from a fan arrangement to the region surrounding a bottom of the refrigerated display cabinet.

12. The method of dispersing the build-up of refrigerant gas beneath the refrigerated display cabinet as claimed in claim 11, wherein the fan arrangement is powered separately to a refrigeration loop of the refrigerated display cabinet or the remainder of the refrigerated display cabinet, and the method comprises:

powering the fan arrangement to direct air to the region surrounding the bottom of the refrigerated display cabinet regardless of the power status of the refrigeration loop of the refrigerated display cabinet or the remainder of the refrigerated display cabinet.

13. A method of manufacturing a refrigerated display cabinet, the method comprising:

providing a refrigerated display cabinet according to claim 1, the refrigerated display cabinet including:

a refrigeration loop comprising a compressor, a condenser, a throttling element and an evaporator;

a main body comprising a storage space, wherein the evaporator is for cooling the storage space and wherein at least one of the compressor, condenser and throttling element are located outside of the storage space; and a fan arrangement located outside of the storage space, configured to direct air to disperse any build-up of gases located in a region surrounding the bottom of the refrigerated display cabinet, wherein the fan arrangement is powered separately to the refrigeration loop or the remainder of the refrigerated display cabinet.

14. The method of manufacturing a refrigerated display cabinet as claimed in claim 13, the method comprising:

retrofitting the fan arrangement to an existing refrigerated display cabinet.

* * * * *